US005222526A

United States Patent [19]

Derudder

[11] Patent Number: 5,222,526

[45] Date of Patent: Jun. 29, 1993

[54] TACKLE DEVICE FOR A DOUBLE LIFT OPEN-SHED JACQUARD MACHINE

[75] Inventor: Carlos Derudder, Kortrijk-Heule, Belgium

[73] Assignee: N.V. Michel Van de Wiele, Kortrijk-Marke, Belgium

[21] Appl. No.: 846,667

[22] Filed: Mar. 5, 1992

[30] Foreign Application Priority Data

Mar. 6, 1991 [BE] Belgium ..... 9100214

[51] Int. Cl.[5] ..... D03C 3/40

[52] U.S. Cl. ..... 139/65; 254/396

[58] Field of Search ..... 139/21, 65; 254/396, 254/394, 395

[56] References Cited

U.S. PATENT DOCUMENTS 4,530,382 7/1985 Schleicher .

5,038,837 8/1991 Palau et al. ..... 139/65

FOREIGN PATENT DOCUMENTS 529019 4/1957 Belgium .

548296 11/1959 Belgium .

0421370 4/1991 European Pat. Off. ..... 139/65

2939714 10/1980 Fed. Rep. of Germany .

64-40630 2/1989 Japan .

883257 11/1961 United Kingdom .

2218715 11/1989 United Kingdom ..... 139/65

*Primary Examiner*—Andrew M. Falik

*Attorney, Agent, or Firm*—James Creighton Wray

[57] ABSTRACT

A tackle device for lifting at least one warp thread in an open-shed jacquard machine, with two complementary hooks, in which one end of each of a first tackle cord is fixed to one hook and the other end to a second adjacent hook. A first tackle element with two rotary rollers is suspended in a loop formed by the first tackle cord. A second tackle cord is attached at one end to a fixed point of the first tackle element and runs around a third rotary roller of a fixed second tackle element further going around the second roller of the first tackle element and having the other end attached to a warp thread.

18 Claims, 3 Drawing Sheets

FIG. 1b
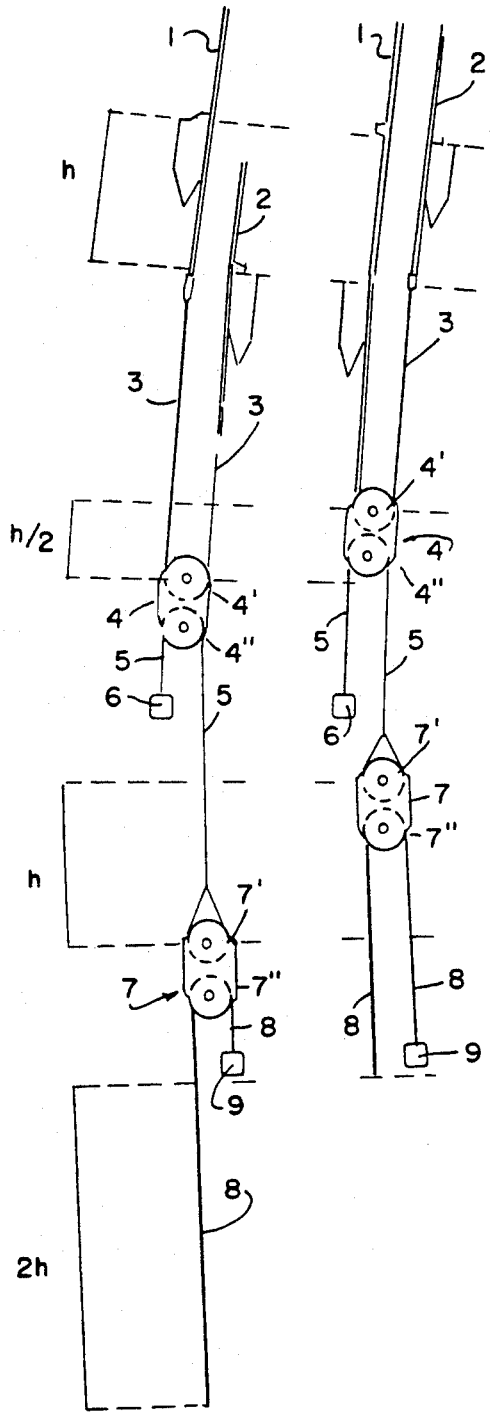
PRIOR ART
FIG. 1a
FIG. 2b
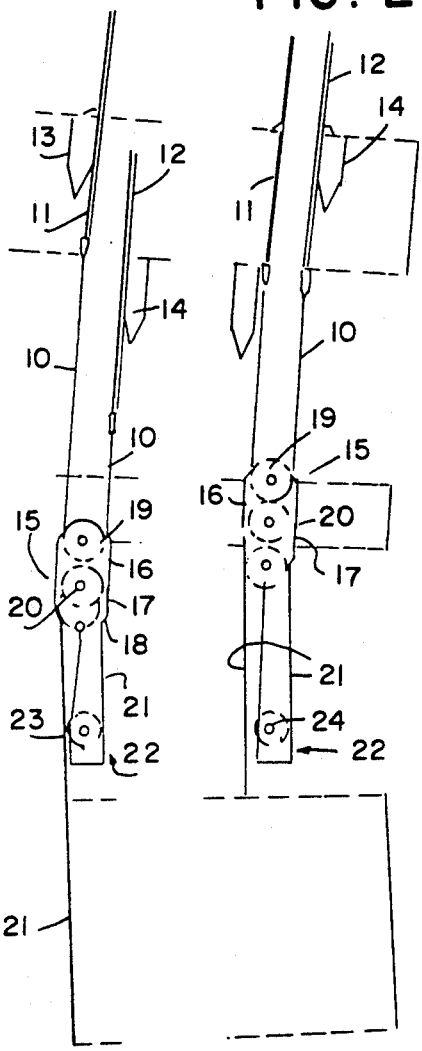
FIG. 2a

TACKLE DEVICE FOR A DOUBLE LIFT OPEN-SHED JACQUARD MACHINE

BACKGROUND OF THE INVENTION (a) Field of the Invention

The object of the invention described below is a tackle device of an open-shed jacquard machine, by means of which the warp thread(s) connected thereto can be raised to height (h'), starting from a lift (h) on the knife grate. The height (h')is greater than (h). This feature is called movement reinforcement. This invention relates more particularly, on the one hand, to such a movement-reinforcing tackle device, comprising a movable and a fixed tackle, for which only one fixed grate is needed and, on the other, to such a fixed tackle with mounting devices.

(b) Prior Art

It is known that in a jacquard machine at least one mounting of two complementary rows of hooks can be provided, in which each hook—depending on the row to which it belongs—can be taken along by one of two knives moving up and down in counterphase or can be held in its top or its bottom position by means of selection mechanisms while the knife carries out the up and down movement.

Two hooks (1), (2) standing directly opposite each other, as shown in appended FIGS. 1*a* and 1*b*, and belonging to a different complementary row, are connected in this type of jacquard machine to the same tackle cord (3) which bears a movable tackle element (4). The tackle element (4) is composed of two rotary rollers (4') and (4''). The tackle cord (3) is connected to the bottom end of the hooks (1), (2) and hangs down, where it runs over the top roller (4') of tackle element (4). A second tackle cord (5) runs over the bottom roller (4'') of tackle element (4), one end of which cord is connected lower down to a grate (6), while the other end is firmly fixed lower down to the top roller (7') of a second movable tackle element (7) with rollers (7') and (7'') which is identical to tackle element (4). A third tackle cord (8) runs over the bottom roller (7'') of tackle element (7), which cord is connected with one end lower down to a grate (9), and is connected by the other end by means of a harness cord to a warp thread.

The provision of such a tackle device means that, for each warp thread which has to be guided through the jacquard machine, each warp thread can be raised separately as desired to a certain height, depending on the weave to be woven. These two positions of the warp threads correspond to different possible positions for the hooks (1), (2) connected to them.

For example, each hook (1), (2) can be selected at the same height, with known selection means, i.e. in the highest position to which each hook is taken by a knife. If, for example, hook (1) is held up by selection, the knife below (1) will drop, and the knife below hook (2) will then carry out a lift (h). The lowest position of a certain warp thread corresponds to the situation in which both hooks (1), (2) move freely up and down with their respective knives. The highest position of a certain warp thread is achieved when both hooks (1), (2) are in their highest position (see FIG. 1*b*). For a lift of a hook (2) over a height (h) (compare FIG. 1*a* and FIG. 1*b*) one obtains a lift over a height 2*h* of the warp thread. While the hook (1) was selected up, the lifting of hook (2) over a height (h) causes a lifting of tackle element (4) over a height (h/2). The tackle cord (5) pulls the tackle element (7) up over a height (h), so that tackle cord (8) lifts the warp thread up over a height (2*h*).

However, such tackle devices have a number of major disadvantages. In the first place, such a mounting requires a fairly large overall height. For, quite a large distance is needed between the underside of the hooks (1), (2) and the warp threads, since the two movable tackle elements (4), (7) have to be suspended below one another and with sufficiently long tackle cords (3), (5), (8) below said hooks (1), (2) and above said warp threads, without hampering the movements of hooks (1), (2) and warp threads. This great overall height makes it necessary for this device to take up a fairly great height between the jacquard machine and the harness, so that the jacquard machine has to be set up higher, in order still to obtain an acceptable bend angle in the harness.

An advantage of the tackle device according to the invention is that a device which now needs only one fixed grate is obtained, with he result that a simpler and cheaper mounting can be achieved.

Another advantage of the invention lies in the fact that the use of only one fixed grate means that a much smaller overall length is needed for the complete tackle device, with the result that the jacquard machine working with it can be placed less high, which again results in a construction which is simpler and cheaper to produce.

A further advantage of the invention lies in the fact that the mounting of the fixed tackle elements slid onto a rail (25) next to each other means a great simplification of the device.

Yet another advantage of the invention, and more specifically of the embodiment of a fixed tackle element shown in FIGS. 3*a* and 3*b*, and its possibilities of use lies in the ease with which this type of tackle element can be removed from a whole series of such fixed tackle elements.

Another disadvantage of the known tackle device described above lies in the fact that two grates (6), (9) lying one above the other have to be provided (one for each movable tackle element (4), (7), with the result that a cumbersome and expensive construction is necessary.

SUMMARY OF THE INVENTION

The object of the invention is to eliminate these disadvantages by providing a tackle device comprising a movable and a fixed tackle element, so that only one fixed grate is necessary, which results in a smaller overall length and also a simpler and less cumbersome mounting which is cheaper when compared with the existing tackle device.

One object of the invention is a tackle device which, through its interaction with, on the one hand, two complementary hooks and, on the other, one or more warp threads, can lift said warp thread(s) with movement reinforcement to a certain height, and comprises an upper movable tackle element with two rotary rollers fixed one above the other and a lower fixing point for a tackle cord, and also a fixed tackle element with one rotary roller, connected by tackle cords for interaction.

The ends of a downward hanging tackle cord are fastened at the bottom end of two complementary hooks. This tackle cord carries the upper movable tackle element hanging with its upper roller in the tackle cord.

A second tackle cord which is connected with its one end lower to one or more warp threads runs upwards and is passed over the lower roller of the movable tackle element, then runs back down and is passed over the roller of the fixed tackle element, and finally runs upwards, where the other end is connected to the underside of the loose tackle element.

Lifting one of the hooks over a height (h) (while the complementary hook remains up) causes the movable tackle element to be raised over a height (h/2) by the tackle cord bearing this tackle element. The lower tackle cord is also pulled up over a height (h/2) at its end fastened to the movable tackle element, while the lower roller of the movable tackle element—over which this tackle cord lies—also moves up a height (h/2). At the level of the end of the tackle cord which is connected to the warp threads we obtain, on the one hand, a lift over a height (h/2) through the fact that the other end has been raised over that distance and, on the other, in addition to this, a lift over a height (h) because the roller over which said tackle cord lies has been raised a distance (h/2). The result is a lift over a height 1.5 h.

Another object of the invention is a fixed tackle element and its mounting devices for a tackle device such as that described above. The fixed tackle element according to the invention in a first possible embodiment comprises two plate-shaped flank pieces which with their top side laterally enclose the roller on a shaft and lie in planes at right angles to the shaft direction, and along the bottom are each provided with an identical transverse opening or with a recess which opens out into an edge, so that the tackle element can be pushed onto a rail or similar element lying parallel to the shaft of the roller, thereby enclosing said rail with said opening or recess or a profiled edge thereof, with its flank pieces in planes at right angles to the lengthwise direction of said rail.

These two lateral flank pieces can be moved away from each other, in order to remove the roller by pushing it away from its shaft.

In jacquard machines the hooks are disposed immediately next to each other in rows, so that in the case of the mounting of several tackle devices according to the invention they extend vertically and close together, parallel to each other. The fixed tackle elements are then fixed on a rail or slat or similar element next to each other with a small space between them, with their lateral flank pieces directed vertically upwards, and parallel to each other. These tackle elements are slid one by one onto said rail from its end, and may be separated from each other by spacers which can be slid onto said rail, while to the left and right of a series of tackle elements slid onto a rail means can be provided, fixed on the rail, to prevent lateral shifting of the tackle elements.

In order to ensure that for the removal of one particular tackle element all tackle elements to the left or right of that element in the same row do not also have to be slid off the rail, in a variant embodiment of a fixed tackle element according to the invention provision is made for a fixed tackle element made up of two parts which can easily be detached from each other, while each part at the bottom encloses a part of the rail or similar element, so that each part can be removed from it separately without sliding it to the end of said rail or similar element, while the two component parts of the tackle element form a transverse opening or recess each permitting a shift on the rail or similar mounting device.

Further features and advantages of the tackle device and of the fixed tackle element with its mounting devices according to the invention are explained in the detailed description which follows of preferred embodiments thereof, but the invention is not limited to these embodiments.

BRIEF DESCRIPTIONS OF THE DRAWINGS

This description is illustrated with reference to the appended drawings, in which:

FIGS. 1*a* and 1*b* show prior art tackle devices.

FIGS. 2*a* and 2*b* give a schematic illustration of a side view of a tackle device according to the invention, when only one of the two hooks is in its highest position, and when both hooks are lifted to their highest position respectively.

FIGS. 3*a* and 3*b* give a perspective view of the dismantled parts of the fixed tackle element, according to one possible preferred embodiment, seen from the top and from the bottom side respectively.

FIG. 4 gives a perspective view of the mounting of different tackle devices according to the invention, as they are provided next to one another interacting with the hooks and warp threads on a jacquard machine, while fixed tackle elements, according to another preferred embodiment then shown in FIGS. 3*a* and 3*b*, are placed on their mounting devices.

DETAILED DESCRIPTION OF THE PREFERRED EMBODIMENTS

The tackle device according to a preferred embodiment of the invention (FIGS. 2*a* and 2*b*) interacts with two complementary hooks (11), (12) of a jacquard machine, in which said hooks (11) and (12) can be carried along by a knife (13), (14), and can each be held individually in the highest position by means of known selection devices. When a knife (13) is high, knife (14) is low, with a height difference equal to (h).

Figure 4:
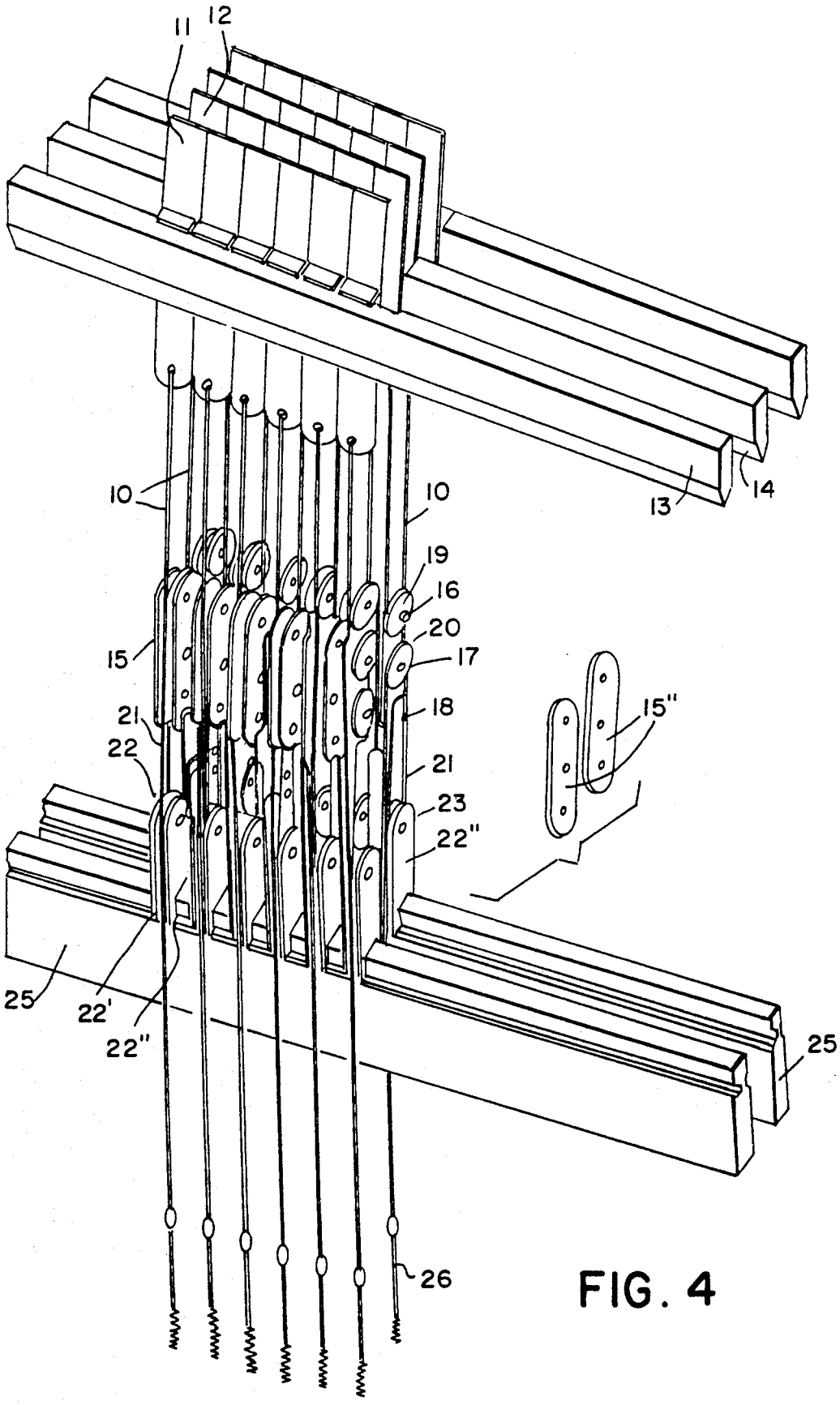

The tackle device, according to the preferred embodiment of the invention (FIGS. 2 and 4), comprises a tackle element (15) composed of two identical elongated o flat plates (15'), (15'') which are interconnected parallel to each other a short distance apart by three shafts (16), (17), (18). These shafts (16), (17) and (18) extend at right angles to the faces of the plates (15') and (15'') into the space between the two plates (15') and (15''), from one plate to the other, and are situated in the same plane of symmetry of the tackle element (15) lying in their lengthwise direction and perpendicular to the plates (15') and (15'').

Rotary rollers (19), (20) rest on the shafts (16) and (17), while the shaft (18) remains free for fixing the end of a tackle cord (21) to it.

The running surface of the rollers (19) and (20) is provided over the entire periphery with a U-shaped recess or with laterally raised edges, for guiding the tackle cords (10), (21) running over said running surfaces. The tackle device according to the invention also has a tackle cord (10) which runs from the one end connected to the hook (11) down over the underside of the roller (19) and then back up, where the other end is connected to the hook (12). The tackle element (15) consequently hangs with its roller (19) in the loop formed by the downward hanging tackle cord (10). The tackle element (15) thus hangs vertically with the shafts (16), (17) and (18) lying in this order from top to bottom on a vertical straight line.

The tackle device according to the invention also has a fixed tackle element (22) which in a first possible preferred embodiment according to the invention comprises two identical elongated, flat and plate-shaped pieces (22') and (22'') which are disposed parallel to each other and at a short distance from each other, and are connected to each other by a shaft (23). This shaft (23) extends from one plate to the other, at right angles to both plates (22'), (22'') close to one of their transverse edges, in the space between plates (22') and (22'').

The transverse edge of the two plates (22') and (22'') lying close to the shaft (23) is called the top edge and is rounded off. The lower transverse edge is straight, lying at right angles to the lengthwise direction, and is called the bottom edge. A rotary roller (24) is disposed on the shaft (23), and is provided with a U-shaped recess or raised edges running over the entire running surface, for guiding the tackle cord (21).

During the setting up on a jacquard machine each complementary set of hooks (11), (12) is, of course, provided with such a tackle device so that a large number of such tackle devices extend vertically close to each other. The tackle element (22) in this case must always be fixed relative to the machine on mounting devices provided for the purpose and comprising a horizontally disposed grate composed of a number of rails (25) extending horizontally and parallel to the knives (13), (14). All tackle elements (22) which interact with the same two rows of complementary hooks (11), (12) can be fixed next to each other on each rail (25). The tackle devices extending next to each other are disposed in such a way that the lateral plates (15'), (22') and (15''), (22'') of the tackle elements (15) and (22) are in the same vertical planes respectively lying at right angles to the lengthwise direction of the knives (13) and (14). The tackle elements (22) consequently have to rest on the rail (25) in such a way that their flank plates (22'), (22'') lie in a plane vertically intersecting the longitudinal axis of the rail (25). This takes place through the fact that from the underside of the two plates (22') and (22'') a T-shaped recess is provided in each of said plates, the recesses of the two plates (22') and (22'') being directly opposite each other with the narrowest upright part of the T-shape opening out in the bottom transverse edge. This T-shaped recess allows the tackle element (22) to slide onto the T-shaped top edge of a rail (25), in order to ensure its secure fixing in the correct position.

Each tackle element (22) sits pushed onto the rail (25), one parallel next to the other with a fixed small space between them. In order to ensure that this fixed spacing is retained, a spacer—with the same T-shaped recess—is slid between every two tackle elements (22) (not shown. This space—and consequently the width of these spacers—is determined in such a way that each tackle device (all tackle cords and tackle elements) extends vertically from the fastening points to the hooks (11), (12) to the fastening point to the warp thread(s) or harness cord (W) in FIG. 1. This space consequently depends on the horizontal distance between the fastening points of the tackle cords (10) of two adjacent hooks (11) and (12).

The lateral plates (2',) and (22'') of each tackle element (22) are interconnected in such a way—by means of the shaft (23)—that they are easily taken apart, for example by means of a clip connection or by means of any known connecting device permitting rapid and easy fitting and removal, preferably without the use of special tools.

When the plates (22') and (22'') are being taken apart, the shaft (23) remains with one end fixed to one of the two plates (22') or (22''), and the roller (24) can be slid off the shaft (23) along the free end of said shaft (23).

The two separate parts (22') or (22'') can be slid separately onto the rail (25), but cannot be removed from said rail (25) unless they are slid to the end of the rail (25), where they can be slid off the T-shaped top edge. If a particular tackle element (22) is to be removed, all tackle elements (22) on the rail (25) to the left or right of that particular tackle element consequently have to be slid off the rail (25), so that the tackle element (22) to be removed can also be slid off the rail (25). In order to eliminate this disadvantage, provision is made for another preferred embodiment of a tackle element according to the invention, which will be described below.

In a preferred mounting of the tackle device according to the invention, one of the ends of a tackle cord (10). is fastened to the bottom end of each of the two complementary hooks (11), (12). In this downward hanging tackle cord (10) hangs the movable tackle element (15) with the roller (19), through the fact that tackle cord (10) is guided over the underside of said roller (19). Lying over the bottom roller (20) of tackle element (15) is tackle cord (21) which runs downwards along one side to the point where the end is connected to the warp thread(s), and runs downwards along the other side, is guided over roller (24) of tackle element (22), and is then taken back upwards, where the other end is connected to shaft (18) of tackle element (15). In order to guarantee the downward movement of the tackle cord (21) connected to the warp thread(s) of and/or to make it take place at a great enough speed, the bottom end of said tackle cord (21) is connected by means of a spring (26) to a fixed point (see FIG. 4).

Figure 3A:
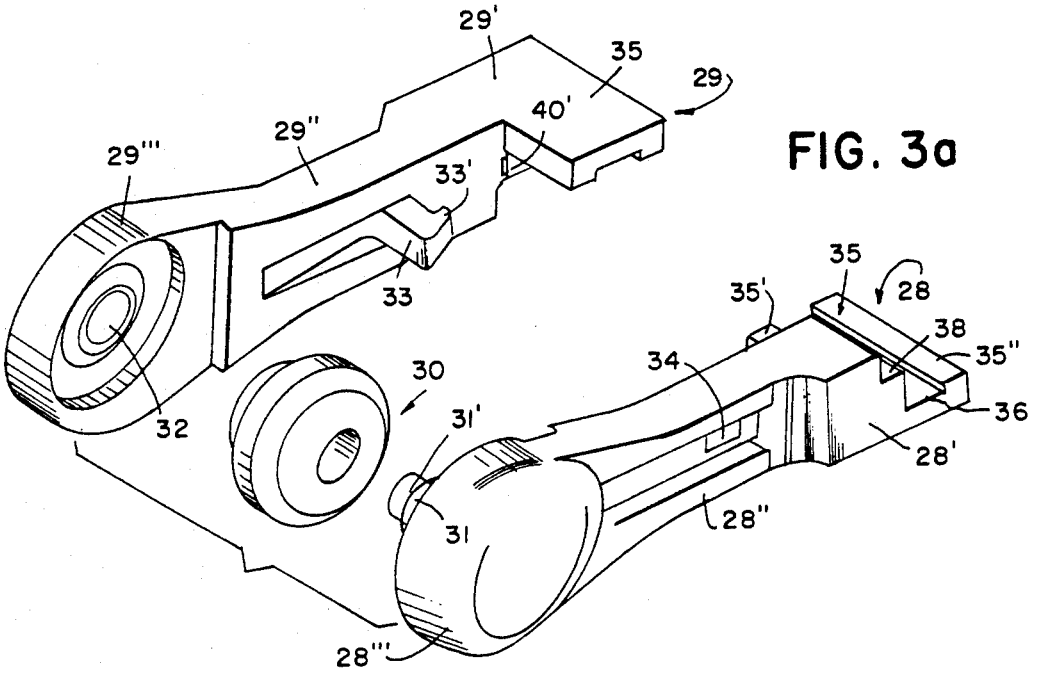
Figure 3B:
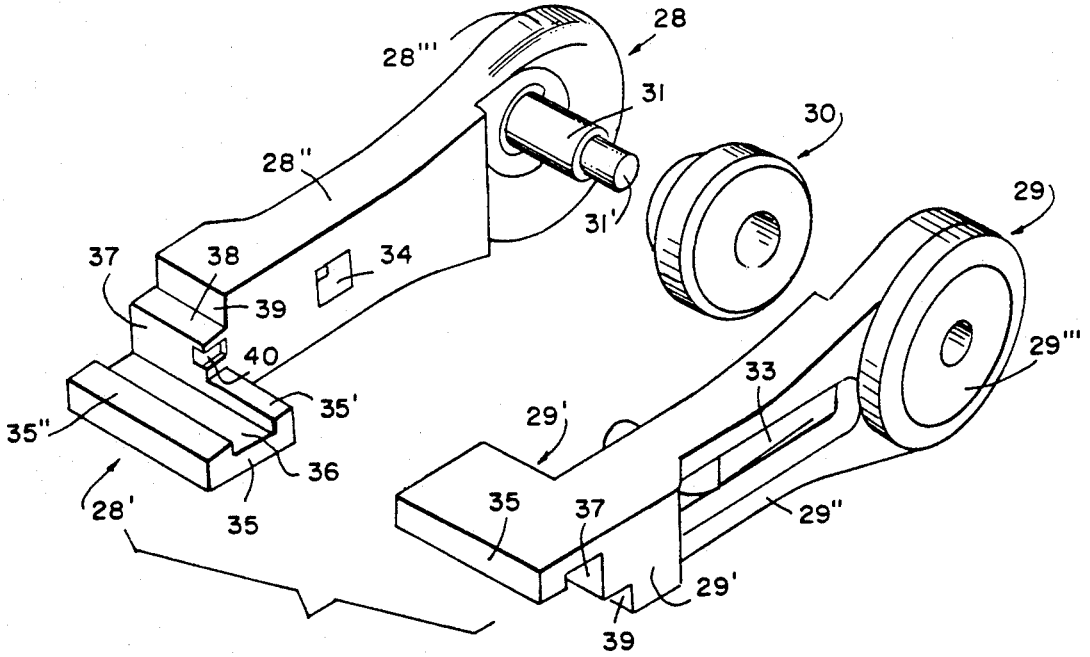

Another possible embodiment of a tackle element according to the invention (see FIGS. 3*a* and 3*b*) is a tackle element which can be dismantled in three different parts (28), (29) and (30), which are the two flank pieces (28) and (29) and the roller (30).

Each flank piece (28), (29) of the tackle element (27) comprises an elongated piece in which three parts can be distinguished: An elongated element (28''), (29'') which passes at one end into a round head (28'''), (29'''), and at its other end is provided with profiled sections (28'), (29'). Along the edges of the flanks (28) and (29) facing each other, the round heads (28'''), (29''') are recessed, while projecting centrally in said recess, in one of the flanks (28), is a shaft (31) which is at right angles to the lengthwise direction of said flank (28), extending in the direction of the other flank (29). On this shaft (31) is a roller (30) whose cylindrical bore which traverses said roller (30) along the axis of symmetry fits round said shaft (31) with slight play, said play being sufficient to .permit turning of the roller (30) about the shaft (31).

A cylindrical recess is provided centrally in the opposite-lying recess in the head (29''') of the flank (29), into which recess the end (31') of the shaft (31), with smaller diameter than the shaft (31) itself, can be pushed. When the two flanks (28) and (29) are assembled, the roller (30) sits on the shaft (31) of flank (28), and end (31') of shaft (31) is pushed into the recess (32) of flank (29). The diameters of end (31') and recess (32) are such that the end (31') is wedged in said recess (32), thus ensuring a connection of the two flanks (28) and (29). The roller (30) fits with its lateral flanks inside the walls of the recesses in the round heads (28''') and (29''') of the flanks (28) and (29), in such a way that said roller (30) can rotate unimpeded about the shaft (31) when the roller (30) is flanked by the heads (28''') and (29''') of the assembled flanks (28) and (29).

Another connection facility for both flanks (28) and (29) is provided in the elongated elements (28'') and (29'') of the flanks (28) and (29). This connection facility comprises a hook-shaped finger (33) which projects from flank (29) along the side facing flank (28), and a bore (34) provided in flank (28), through which the hook-shaped finger (33) can slide and become slotted through the fact that the hook-shaped end of the finger (33) , going along the other side of flank (28) through the bore (34), springs behind an edge of said bore (34) when the flanks (28), (29) are assembled.

This hook-shaped finger (33) is more specifically composed of an elongated finger (33) bent in a right angle, and with small square section, which forms part of the flank (29), and with the part passing into flank (29) runs more or less parallel to the lengthwise direction of flank (29) in the direction of the fastening parts (29'), and with the part forming a right angle with this part runs in the direction of the flank (28). The end of this latter part ends with a hook shape (33') running in the direction of the fastening parts (29') .

A traversing bore (34) is provided in flank (28) opposite the ending part (33') of the finger (33). When the flanks (28) and (29) are being assembled the hook-shaped ending part (33') of the finger (33) can be inserted into the bore (34)—which has corresponding dimensions—by slightly altering the position of finger (33) relative to the flank (29).

The finger (33) can be bent elastically, so that it goes into another angle relative to the flank (28). For insertion of the ending parts (33') of the finger (33) into the bore (34), the finger must be pushed in the direction of the flank (28). When this hook-shaped part (33') has been passed through the bore (34), the finger (33) springs back to its original position. The hook-shaped part (33') thereby slots behind the edge of the bore (34) along the outside of the tackle element.

Finally, each of the flanks (28), (29) ends with a profiled part (28'), (29'). These parts (28'), (29') are formed in such a way that together, when the flanks (28) and (29) are assembled, they form a bar-shaped part over the full width of the tackle element, which bar-shaped part is provided over its full width with a symmetrical T-shaped recess which opens out with the upright part of the T-shape into the flat side which forms—at right angles to the lengthwise direction of the tackle element—the ending flat wall of said tackle element. The parts (28') and (29') are the same shape, but in the position in which they have to be assembled one of them is turned through an angle of 180° relative to the other, about an axis parallel to the longitudinal axis of the flanks (28), (29).

If we look at the part (28') of a down-lying left flank (28) (see FIG. 3*b*) , it comprises a horizontal bar-shaped part (35) with a bottom flat side in line with the bottom side of the element (28''), laterally running out wider over a width corresponding to the width of the assembled tackle element, and with a height which is less than half the height of the element (28''). A U-shaped channel (36) is provided over the full width in the top side of this bar-shaped part. Said channel (36) has a front flank which slants down backwards, widening the channel (36) towards the bottom. Over the width of the element (28'') the rear flank (37) of said channel is made higher, and via a horizontal part (38) which connects along the top over its full width to said higher wall (37) and a vertical wall (39) connecting over its full width to said horizontal part, passes into the top side of the element (28''), said top side of element (28'') connecting to the top side of said vertical wall (39) over the entire width.

When the flanks (28) and (29) are being assembled, the rear flat part (35') of the bar-shaped part (35) of flank (29) lying along the channel (36) comes to lie on the horizontal part (38) of flank (28), with the channel (36) at the bottom. The horizontal part (38) of flank (29) comes to rest on the rear flat part (35') of the bar-shaped part (35) of flank (28) lying along the channel (36).

The sides lying at right angles to the lengthwise direction of the channels (36) and connecting to the parts (37) and (38) of the two flanks (28) and (29) come to rest against each other, and are provided respectively with a recess (40) and a projection (40') fitting into it, in order to ensure the correct positions of the two parts (28), (29) relative to each other. If we look at the assembled tackle element in the vertical position which it has to assume in order to be pushed onto a rail (25) with T-shaped top edge, then the channels (36) form the lateral arms of the T-shaped recess, with upward tapering bottom flanks, and the upright part of the T-shaped recess which opens into the underside of the tackle element (27), and has to enclose the upright part of the T-shaped edge of rail (25), is formed by the free space between the bottom flat parts (35'') of the two bar-shaped parts (35) lying along the channel (36).

When a series of such tackle elements are disposed next to each other slid onto a rail (25) with T-shaped top edge, in order to remove one of said tackle elements from it, the two flank pieces (28), (29) need only be pushed apart a little, for the two parts (28), (29) to be removed from the rail (25). It is no longer necessary to slide to the end of the rail (25), so that it is no longer necessary—as in the case of the tackle elements (22) (shown in FIG. 4)—to slide the tackle elements to the right or left of it in the same row off the rail (25) before the desired tackle element can be slid off the rail (25).

I claim:

1. In a open shed jacquard machine including at least one tackle device for raising and lowering at least one warp thread, by means of at least one knife element acting on at least one hook element, wherein the improvement comprises at least one tackle, having a movable tackle element, a fixed tackle element, and a connecting cord, which connects the movable tackle element to the hook element, and a tackle cord for connecting the movable tackle element to the fixed tackle element, the tackle cord having one end being connected to a warp thread and having another end being fastened to one of the two tackle elements, wherein the fixed tackle element is movable on an elongate mounting element, the mounting element being a parallel to the knife element, while the fixed tackle element is in a plane perpendicular to a longitudinal direction of the mounting element and wherein the fixed tackle element includes means for being attached on the mounting element in a selectable shift position.

2. The tackle device as claimed in claim 1, which comprises at least two mutually parallel and spaced-apart mounting elements, in the form of rails (25), wherein each of the tackle cords run between the mounting elements to the warp threads.

3. The tackle device as claimed in claim 1, wherein the connecting cord (10) and the tackle cord (21) of the tackle run substantially in a common plane, perpendicular to a longitudinal direction of the knife.

4. The tackle device as claimed in claim 1, wherein the connecting cord (10) is led over a first roller of the movable tackle element (15), and wherein each of a first and a second end of the connecting cord is fastened to adjacent hook elements (11, 12).

5. The tackle device as claimed in claim 4, wherein at least one of the rollers is designed as a deflecting roller (19,20,24,30).

6. The tackle device as claimed in claim 1, wherein the another end of the tackle cord (21) fastened to the movable tackle element (15) is subsequently led over a first roller of the fixed tackle element (22) and then over a second roller of the movable tackle element (15).

7. The tackle device as claimed in claim 1, wherein the fixed tackle element (22) has two side pieces (22', 22'', 28, 29), between which a roller (24, 30) is rotatably mounted, and wherein the two side pieces (22', 22'', 28, 29) are releasably connected to each other.

8. The tackle device as claimed in claim 7, wherein each of the two side pieces (22', 22'') is provided with a guide recess for the embracing acceptance of a guide profile.

9. The tackle device as claimed in claim 7, wherein each of the two side pieces (28, 29) is provided with a partial recess, only partially accepting a guide profile, and wherein the two partial recesses complement each other to form the guide recess.

10. The tackle device as claimed in claim 9, wherein, the two releasably connected side pieces (28, 29) are adapted to be movable away from each other and from the mounting element in a plane perpendicular to the longitudinal direction of the mounting element.

11. The tackle device as claimed in claim 7, wherein the releasable connection between the two sides is formed by a catch hook (33), which is provided on one of the two side pieces (28, 29) and engages in a complementary catch opening (34) of what is respectively the other side piece (29, 28).

12. The tackle device as claimed in claim 1, wherein the mounting element is designed with a guide profile, essentially T-shaped, and wherein the fixed tackle element (22) has a guide recess, which is essentially complementary to a cross-section of the guide profile, for the embracing acceptance of the guide profile.

13. The tackle device as claimed in claim 1, wherein the fixed tackle element (22), (27) is slidably attached onto a rail (25), said rail (25) forming part of a fixed grate on the jacquard machine, and extending parallel to the at least one knife element.

14. The at least one tackle device as claimed in claim 1 comprising several tackle devices wherein the tackle elements are slidably attached onto a same rail (25) adjacent to each other.

15. A tackle arrangement as claimed in claim 14, wherein between each of the adjacent tackle elements (22, 27), a spacer is slid onto the rail (25).

16. The tackle device as claimed in claim 1, wherein the fixed tackle element comprises first and second parallel flank pieces, each flank piece having first and second ends. respectively, the flank pieces being detachably interconnected by a shaft positioned at right angles thereto which extends in a space between the first and second flank pieces, a rotary roller disposed on the shaft between the flank pieces, and the second end of each of the flank pieces being formed as a flange perpendicular to a longitudinal direction of the flank pieces, whereby the flange of the first flank piece and the flange of the second flank piece together form a front wall and a rear wall respectively of an opening, said opening extending through an end of the tackle element parallel to the shaft thereby forming a recess for a passage for a rail, the tackle element being removably mountable and slidably movable along a lengthwise direction of the rail.

17. The tackle device as claimed in claim 16, wherein the flanges of the flank pieces together forming the recess are identical, but on assembling are directed such that one of the flanges is rotated through an angle of 180° relative to the other flange, about an axis parallel to the longitudinal axis of the flank pieces, each of the flanges comprising a horizontal bar-shaped part with a flat side in line with a bottom side of the flank piece and a lateral side extending in a direction of the other flank piece, the lateral side having a width the same as that of an assembled tackle element and having a height less than half a height of that of the tackle element, and an upper side of the bar-shaped part having a U-shaped channel provided over the width, the channel having a front flank which slants down backwards widening the channel towards the bottom, and a rear flank of the channel being higher than the front flank, said rear flank being connected by means of a horizontal part along the top over the full width thereof to the rear flank and by means of a vertical wall to the horizontal part over the full width thereof, and the rear flank being connected to a top side of the flank piece over the full width thereof.

18. The tackle device of claim 16, further comprising an angular finger projecting from a sidewall of the first flank piece and a corresponding bore on a sidewall of the second flank piece facing the first flank piece, said finger being removably insertable into the bore, sad finger further having an extended end part for removably locking the first and the second flank pieces after assembling the flank pieces.

* * * * *